United States Patent [19]

Jenkner

[11] Patent Number: 4,830,075

[45] Date of Patent: May 16, 1989

[54] DEVICE FOR HOLDING DOWN AND GUIDING WORKPIECE PLATES

[76] Inventor: Erwin Jenkner, Lindenstrasse 13, Gechingen, Fed. Rep. of Germany, D-7261

[21] Appl. No.: 106,221

[22] Filed: Oct. 8, 1987

[30] Foreign Application Priority Data

Oct. 8, 1986 [DE] Fed. Rep. of Germany ..... 3634199

[51] Int. Cl.[4] ..... B27B 1/12

[52] U.S. Cl. ..... 144/253 R; 83/437; 83/438; 144/249 R; 144/249 A

[58] Field of Search ..... 269/309; 83/156, 157, 83/437, 438, 446, 447, 450; 144/242 A, 249 R, 249 A, 253 R, 253 F

[56] References Cited

U.S. PATENT DOCUMENTS

| | | | |
|---|---|---|---|
| 1,089,901 | 3/1914 | Carson | 144/249 R |
| 1,744,874 | 1/1930 | Edwards | 144/249 R |
| 1,744,875 | 1/1930 | Edwards | 144/249 R |
| 1,770,106 | 7/1930 | Johnson | 144/249 R |
| 4,531,438 | 7/1985 | Pair | 144/249 R |

FOREIGN PATENT DOCUMENTS

P973800 9/1956 Fed. Rep. of Germany .

*Primary Examiner*—W. Donald Bray
*Attorney, Agent, or Firm*—Dick and Harris

[57] ABSTRACT

A device for holding down and guiding workpiece plates to be machined on a wood working machine and advanced along a straightedge to ensure that the workpiece plates during the feed movement remain with one of their trimmed longitudinal edges in steady contact with the straightedge for the purpose of accurate alignment. The device includes a holding-down and guide member placed by means of a roller exerting a predetermined pressure in close contact with the upper side of a workpiece plate, with the central axis of rotation of the roller and the longitudinal axis of straightedge forming an acute angle as viewed in the direction of feed.

4 Claims, 2 Drawing Sheets

DEVICE FOR HOLDING DOWN AND GUIDING WORKPIECE PLATES

BACKGROUND OF THE INVENTION

The present invention relates to a device for the holding down and guiding of plates of sawed lumber on a wood working machine to be machined on either or both of their flat faces and advanced along a straightedge provided on the wood working machine.

Wood working machines for providing one or both faces of plate-shaped lumber with grooves and/or bores, or for separating such plates into smaller pieces, conventionally include a workpiece feed mechanism for advancing the workpiece either in one direction only or in opposite directions. Such feed mechanism advances the workpiece plate stepwise along the straightedge on the machine that extends in the direction of feed movement, whereby one of the trimmed longitudinal edges of the workpiece plate is in close contact with the straightedge.

The exact course of saw cuts and/or the laying of a pattern of bores and grooves in a workpiece plate hinges on the ( accuracy of the alignment of the workpiece plate relative to the straightedge over the entire feed distance. However, the proper alignment and/or abutment of the particular trimmed longitudinal edge of a workpiece plate with the straightedge poses certain problems because the workpiece feed mechanism grips workpiece plates having a length of 3 meters to a maximum of 5 meters at their rear ends by means of clamps to move the workpieces along. So, at a workpiece length of several meters, the guiding of the end portion of the workpiece plate that is opposite the feeding part proper of the feed mechanism is rather unstable relative to its plane of support which is perpendicular to the straightedge. Accordingly, with conventional devices an accurate positioning of the trimmed edge of the workpiece plate against the straightedge on the machine during the feed movement cannot always be ensured even if the part of the feeding mechanism that actually effects the advancing of the workpiece is properly installed and guided.

The object of the invention therefore resides in improvements on the conventional workpiece feed mechanism of wood working machines so as t ensure a steady reliable contact between the trimmed longitudinal edge of the workpiece and the straightedge of the machine over the entire feed distance.

This is accomplished by the characterizing features of the claimed invention, as described more fully hereinbelow.

SUMMARY OF THE INVENTION

A workpiece plate undergoing grooving and boring on one of its flat faces can be pressed down on the supporting surface of the machine table by means of the holding-down member exerting the appropriate force required to produce the necessary reactive force. During the grooving operation, the roller continuously rolls upon the workpiece plate. To ensure that simultaneously proper contact between the trimmed longitudinal edge of the workpiece plate and the straightedge is maintained, the roller may be adjusted by swivelling it about its pivot axis into an angular position with respect to the feed direction such as to enable the roller, as it is rolling upon the workpiece plate, to exert on the latter the force acting to maintain steady contact between the longitudinal edge of the workpiece and the straightedge during advancement.

During the machining of bore patterns on the face of the workpiece plate, the roller together with the workpiece plate are at a standstill. The workpiece plate is held on the machine table by a clamping fixture. The roller is merely operative during the stepwise advance of the workpiece for the purpose of applying the necessary contact pressure. The inventive device works substantially in the same manner also when cutting workpiece plates into separate pieces.

If workpiece plates need to be advanced by the feed mechanism merely in one direction, the roller remains in the position in which contact pressure is generated. However, if plates need to be moved into opposite directions, the roller needs to be adjusted to be effective for operation in opposite directions such, that in either direction of feed the desired pressure force is applied to the workpiece plate to keep its trimmed longitudinal edge in steady contact with the straightedge.

For this procedure, the embodiment according to FIG. 2 has been found to be particularly suitable, wherein the roller is adapted, particularly program controlled, to automatically move into the oppositely directed angular positions with respect to the straightedge.

Another advantageous embodiment of the invention can comprise the holding-down and guide member supporting a roller at its free end and being mounted on reciprocating means at its other end, so as to be both pivotable and lockable about an axis. The particular positioning of the roller may also be directly mounted to the holding down and guide member.

The particular preferred arrangement of the inventive device on a wood working machine is made wherein it is secured on supporting means which are adjustable perpendicular to the workpiece plate and extending transversely to the direction of feed of the workpiece plate, with said device being adjustable and lockable along the longitudinal direction of the beam. It is especially advantageous if the inventive device is a self-contained structural unit, which is capable of being added on to a wood working machine.

Further objects and features of the invention will become apparent from the following description of an exemplary embodiment illustrated in the drawings and/or from the claims.

DETAILED DESCRIPTION OF THE DRAWINGS

Figure 1:
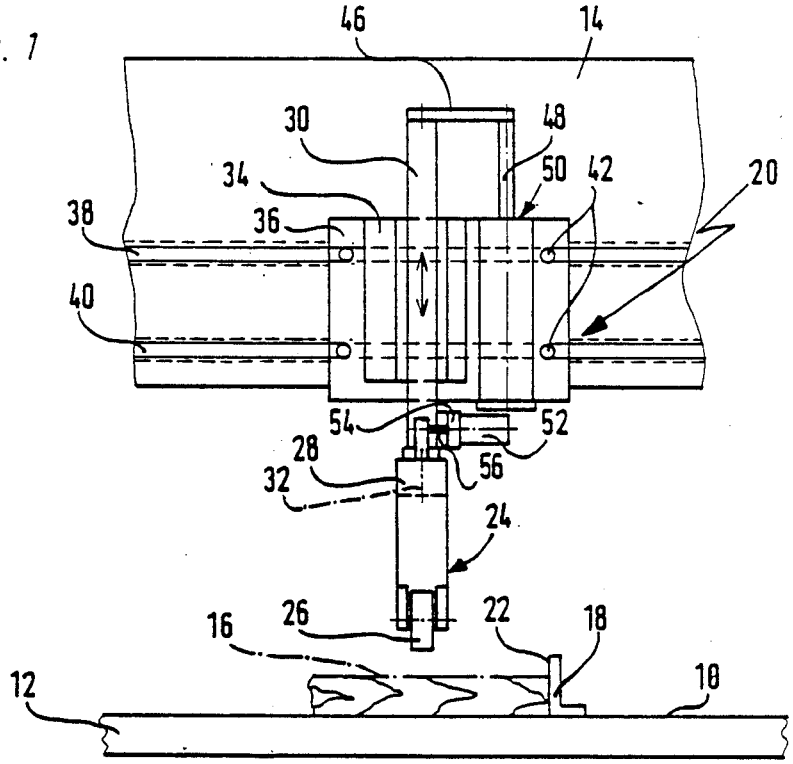
FIG. 1 is a front view of the device according to the invention mounted on supporting means in the form of a compression beam of plate separating means, for example, wherein the holding-down member is lifted from the workpiece plate

Referring to the drawings, 10 designates the horizontal table top surface of a workpiece support 12 of a wood working machine, such as a plate cutting saw, for example.

A compression beam 14 is spaced at a distance above the workpiece table 12 and extends like a yoke across the workpiece table 12 and transversely to the direction of feed. The compression beam 14 is adapted to be lowered onto the table surface 10 to retain the workpiece plate 16 in position and to be lifted for its release, the lowering and lifting being accomplished pneumatically, for example, as known per se.

The underside of the compression beam 14 is provided with bracing members, not illustrated, which extend downwardly and are adapted to be applied to the workpiece plates 16.

To attain an exact alignment of the workpiece plate 16, a straightedge or abutment ruler 18 is provided on the table surface 10 and extends along the direction of advancement.

The mechanism for holding down and guiding a workpiece plate 16 placed on the table surface 10 is as a whole designated 20. The workpiece plate 16 is placed with one trimmed longitudinal edge 22 against the straightedge 18. The hold-down and guide mechanism 20 includes a holding-down and guide member 24 adapted to be lifted and lowered and having rotatably mounted thereon a roller 26 which projects with part of its circumference downwardly on the holding-down and guide member 24. The roller 26 is located at the front end of a projecting arm 28 which extends parallel to the table surface 10 and is mounted on the lower end of a reciprocating member 30 so as to be pivotable and lockable about a pivot axis 32 which is perpendicular to the table surface 10. The reciprocating member 30 is vertically adjustable with respect to the table surface 10.

The reciprocating member 30 is slidably movable in a guide 34 provided at a mounting plate 36. By means of the mounting plate 36 the hold-down and guide mechanism 20 is secured as a whole to the compression beam 14, preferably to be adjustable as well as lockable along the longitudinal axis of the compression beam 14. This may be accomplished with the aid of T-shaped grooves 38, 40 provided in the pressure beam 14 and adapted to receive tenon blocks 44 adapted to be screw fastened by fastening screws 42 on the mounting plate 36.

The rod-shaped reciprocating member 30 is guided preferably in a spherical guide installed in the member 30. Secured to the upper end of the reciprocating member 30 is a piston rod 48 which is part of a cylinder aggregate 50 disposed at the mounting plate 36. The cylinder aggregate serves to lift, preferably pneumatically, the reciprocating member 30 together with the entire hold-down and guide member 24 and to place it under pressure upon the workpiece plate 16, and in so doing, the roller 26 is applied to the workpiece plate 16 at a predetermined pressure force.

Fixedly attached to the reciprocating member 30 by way of a connecting piece 54 is a preferably pneumatically operated pivotable cylinder 52, the piston rod 56 of which is movably hinged to attachment 58 provided on the projecting arm 28.

Figure 3:
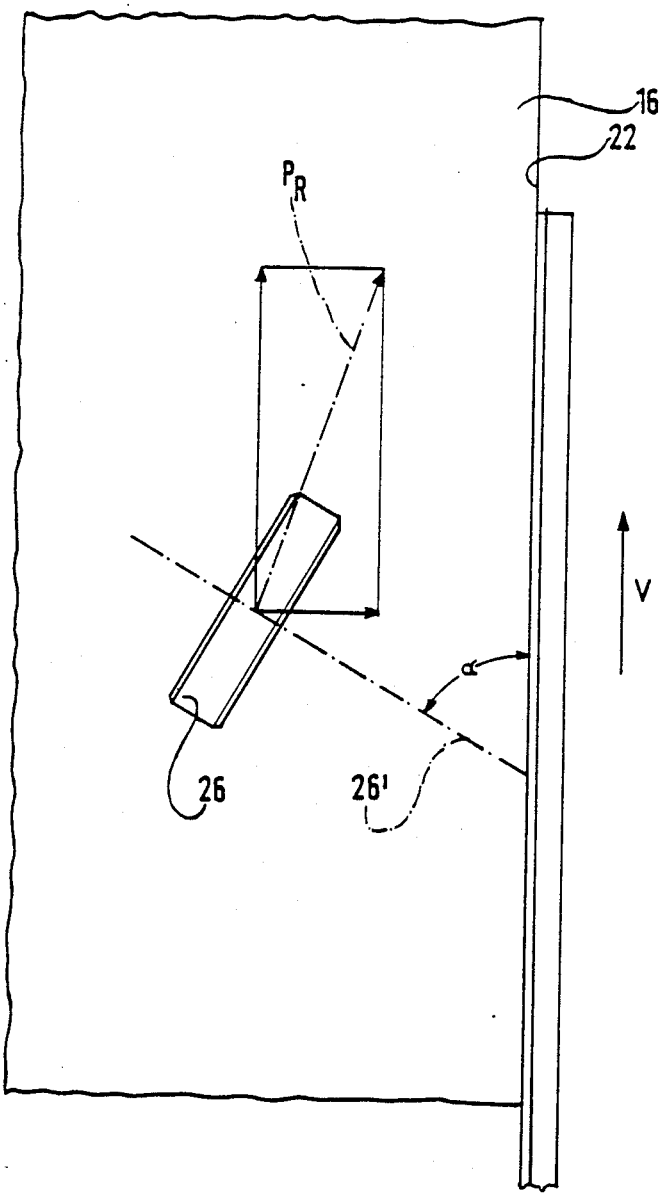
FIG. 3 is a top view of the roller set at an angle with respect to the straightedge to generate the pressure force required for securely holding a workpiece plate in abutment with the straightedge during the feed movement.

The pivotable cylinder 52 serves to swing the projecting arm 28 together with the roller 26, as previously described, about a pivot axis 32 in two directions in order to enable the roller 26 to automatically move into a predetermined angular position with respect to the straightedge 18, as it is shown in FIG. 3. Of course, it is also feasible to swing the arm 28 manually and then fixedly secure it, whereby the roller 26 is correspondingly adjusted along a circular path 60. In another structural embodiment, the rotary axis of the hold-down and guide member 24 might be located below the pivot axis 32.

Suppose a workpiece plate 16 is to be cut into several pieces on a plate separating saw by successively executed cuts. To this end, the plate must be advanced cut by cut along the direction of the arrow V in FIG. 3. To ensure that the plate 16 during these advancing steps remains with its trimmed longitudinal edge 22 in uniform abutment with the straightedge 18 to achieve accuracy of alignment of the workpiece plate 16 with respect to the cutting plane, the holding-down and guide member 24 needs to be pivoted in a manner such that the central axis of rotation 26' of the roller 26 encloses an acute angle "a" of 60°, for example, with the longitudinal axis of the straightedge 18 along the feed direction V. This angular position of the roller 26 is operative to exert a resultant force $P_R$ on the workpiece plate 16 during the feed movement for retaining the workpiece plate 16 in firm contact with the straightedge 18.

For executing the successive cuts, the workpiece plate 16 is held in a fixed position on the table top 10 by lowering the pressure beam 14. The holding-down and guide member 24 is retained in contact with the plate 16 by means of pressure supplied by the cylinder aggregate 50. The pressure is reduced relative to the clamping pressure exerted by the pressure beam 14 by an amount such that during the lowering of the pressure beam 14 the reciprocating member 30 of the unit 20 is free to move relative to its guide. On lifting the pressure beam 14 from the workpiece plate 16, the holding-down and guide member 24 continues to stay in contact with the plate 16, and the roller 26 during the subsequent feed movement is able to resume its function in positioning the plate 16 in alignment and close contact with the straightedge 18. Coating the circumference of the roller 26 with a material having an appropriately high coefficient of friction will further enhance the effect of the particular angular position of the roller.

If the inventive device 20 is used on wood working machines for cutting workpiece plates into several pieces, requiring the workpiece plate 16 to be moved first in one feed direction and, after making a cut, in another direction, the projecting arm 28 needs to be swung about the pivot axis 32 into the opposite direction to effect a reversal of the feed movement relative to the reciprocating member 30 in order to cause the roller 26 to again move into an angular position with respect to the straightedge 18 to enable it to exert also in this feed direction the necessary pressure force on the plate 16 along the straightedge 18. This may be program controlled by means of the cylinder 52.

Figure 2:
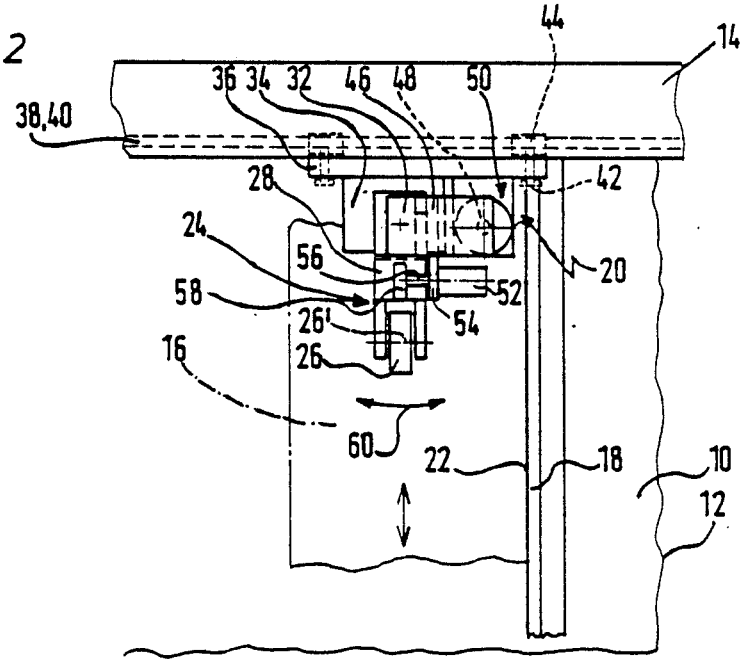
FIG. 2 is a top view of the device according to FIG. 1.

As it is shown in FIG. 2, the pivotable cylinder 52 is also capable of moving the projecting arm 28 into a position and fix it there in which the roller axis 26' is perpendicular to the straightedge 18. This particular position of the roller may be of advantage when workpiece plates are to be grooved on their underside in the feed direction, as the workpiece plates need to be moved along in the feed direction.

Furthermore, the construction of the hold-down and guide mechanism 20 may be such that the axis of rotation of roller 26 is mounted at a predetermined angular position, for example at an angle "a", with respect to the longitudinal axis of straightedge 18 and is not pivotable.

Such structural variation is of advantage when the inventive device is intended for use on wood working machines which feed plates or boards in one predetermined direction only.

What is claimed is:

1. A device for holding down and guiding workpiece plates against a straightedge as said workpiece plates are transported along a feed direction along a horizontal workpiece support surface of a wood working machine and intermittently moved forward and backward along said feed direction when worked by said wood working machine, said device for holding down and guiding workpiece plates comprising:

support means operably arranged above said horizontal workpiece support surface of said wood working machine;

holding-down and guide means operably associated with said support means and arranged for lockable pivotal movement about an axis extending perpendicular to said horizontal workpiece support surface, said holding-down and guide means being further raisable and lowerable in the direction of said axis, said holding-down and guide means including a roller rotatable about an axis parallel to said horizontal workpiece support surface, and arranged to make substantially rolling contact with upper surfaces of said workpiece plates; and angular adjustment means operably associated with said wood working machine and said holding-down and guide means to lockably pivot said holding-down and guide means, in a program controlled manner, relative to said support means, when there is a change in the direction of feed of said workpiece plates, for positioning said roller such that said axis of said roller and said straightedge form an acute angle therebetween, in the direction of feed of said workpiece plates, enabling said roller to substantially continuously prompt said workpiece plates against said straightedge.

2. The invention according to claim 1 further comprising:

vertical adjustment means for lockably positioning said holding-down and guide means vertically relative to said horizontal workpiece support surface.

3. The invention according to claim 2 wherein said holding-down and guide means, said vertical adjustment means and said angular adjustment means comprise a self-contained structural unit adapted to be integrally attached to a wood working machine.

4. The invention according to claim 3, wherein said self-contained structural unit is operably arranged on a compression beam member of said wood working machine, so as to be lockably adjustable transversely to said feed direction, wherein said roller is maintained in contact with said workpiece plates with a pressing force less than a pressing force exerted by said compression beam member.

* * * * *

UNITED STATES PATENT AND TRADEMARK OFFICE

CERTIFICATE OF CORRECTION

PATENT NO. : 4,830,075

DATED : May 16, 1989

INVENTOR(S) : Erwin Jenkner

It is certified that error appears in the above-identified patent and that said Letters Patent is hereby corrected as shown below:

| | |
|---|---|
| Col. 1, Line 24 | "(accuracy" should instead read -- accuracy --. |
| Col. 1, Line 46 | "t" should instead read -- to --. |
| Col. 2, Line 29 | "guide member" should instead read -- guide member, --. |
| Col. 2, Line 56 | "plate" should instead read -- plate; --. |
| Col, 3, Line 48 | "member 30" should instead read -- member 34 --. |

Signed and Sealed this

Seventh Day of January, 1992

*Attest:*

HARRY F. MANBECK, JR.

*Attesting Officer*

*Commissioner of Patents and Trademarks*